United States Patent [19]

Brolund

[11] 4,012,976

[45] Mar. 22, 1977

[54] PUNCH PRESS FOR DUPLICATING WORKPIECES

[75] Inventor: Theodore F. Brolund, Rockford, Ill.

[73] Assignee: W. A. Whitney Corporation, Rockford, Ill.

[22] Filed: Apr. 23, 1975

[21] Appl. No.: 570,762

[52] U.S. Cl. ..... 83/146; 83/413; 83/466; 83/459

[51] Int. Cl.[2] ..... B26F 1/02

[58] Field of Search ..... 83/413, 565, 145, 146, 83/459, 466; 33/174 J; 408/3; 192/131 R; 317/135

[56] References Cited

UNITED STATES PATENTS

| | | | |
|---|---|---|---|
| 1,570,928 | 1/1926 | Thomas | 83/413 X |
| 1,967,626 | 7/1934 | Plummer | 83/413 X |
| 2,958,247 | 11/1960 | Levine | 83/413 X |
| 3,134,284 | 5/1964 | Kidd | 83/413 |
| 3,145,605 | 8/1964 | Langmead et al. | 83/413 |

*Primary Examiner*—Frank T. Yost
*Attorney, Agent, or Firm*—Leydig, Voit, Osann, Mayer & Holt, Ltd.

[57] ABSTRACT

A punch press for producing duplicate piece parts from workpiece blanks includes a C-shaped frame supporting an actuator operable to reciprocate a movable tool element toward and away from a fixed tool element to punch holes in an intervening workpiece blank. The latter is clamped to a carriage for movement between the tool elements within a punching area and the carriage is supported on a movable bed which, in turn, is supported on a worktable mounted separately of the press frame. The bed is slidably mounted for movement in an *x* direction while the carriage is slidably mounted on the bed for movement in a *y* direction thereby enabling *x*, *y* movement of the blank to position it in the punching area. Located on the table adjacent the punching area is a duplicating area within which a first piece part is clamped to the table in a predetermined position with respect to the fixed tool element. A stylus supported on the carriage is adapted to telescope into the holes in the first piece part so as to locate the blank in the punching area for punching corresponding holes in the blank. Clamps holding the blank for movement with the carriage include upper and lower jaws which are movable vertically with the blank to keep from being damaged during stripping. When punching holes in an angle iron workpiece, an adapter is held between the jaws of the clamps to grip against the ends of the angle iron workpiece and hold the latter for movement with the carriage. A locator on the table top below the carriage coacts with a plunger mounted on the carriage to locate the angle iron workpiece between the tool elements for punching holes in one leg of the workpiece along a preselected line extending in the *y* direction.

9 Claims, 13 Drawing Figures

PUNCH PRESS FOR DUPLICATING WORKPIECES

BACKGROUND OF THE INVENTION

The present invention relates to a punch press of the type adapted for use in producing duplicate piece parts such as gusset plates, splice plates, base and cap plates and the like from a plurality of workpiece blanks. More particularly, the invention relates to a method of operating the press to punch identical hole patterns in the workpieces to produce the piece parts.

SUMMARY OF THE INVENTION

The general object of the present invention is to provide a new and improved punch press of the foregoing general character which is adapted for use in a novel manner so that duplicate piece parts having identical hole patterns may be produced from a plurality of workpiece blanks without the need of constructing a special hole template for use in reproducing the hole pattern in each of the blanks.

A further object is to construct the punch press in a unique fashion so as to promote safe operation thereof while still enabling duplicate piece parts to be formed more quickly and accurately than when safely using prior similar punch presses. A more specific object is to construct the press for ease and safety of operation by providing $x$ directional movement of the workpiece blank to be controlled by one hand of the punch press operator and $y$ directional movement to be controlled by the other hand so that, to efficiently use the press, the operator's hands necessarily are kept safely away from the punching area.

Still further, the invention resides in the provision of a unique clamp for holding the workpiece for movement with the carriage, the clamp being constructed to float vertically so as to assure proper stripping of the workpiece blank from the punch and avoid bending or binding of the blank between the clamp and the punch as the latter is retracted from the die. Advantageously, the unique clamp also serves to compensate for a cambered or bowed workpiece blank and may be moved vertically so the blank may be held between the jaws of the clamp without binding or placing an undue strain against the clamp during punching.

In addition, the invention resides in the provision of a unique stylus for use with the first formed piece part in accurately locating and locking the carriage and the workpiece blank in position for the blank to be punched, the stylus being particularly adapted for use with different first formed piece parts having a wide range of sizes of holes formed therethrough.

Also, the invention resides in the provision of a unique adapter mountable between the jaws of the carriage clamp and a locator mechanism for guiding movement of the carriage to enable the press to be used to form clip angles.

These and other objects and advantages of the present invention will become more apparent from the following detailed description when taken in conjunction with the accompanying drawings.

DETAILED DESCRIPTION OF THE PREFERRED EMBODIMENT

Figure 2:
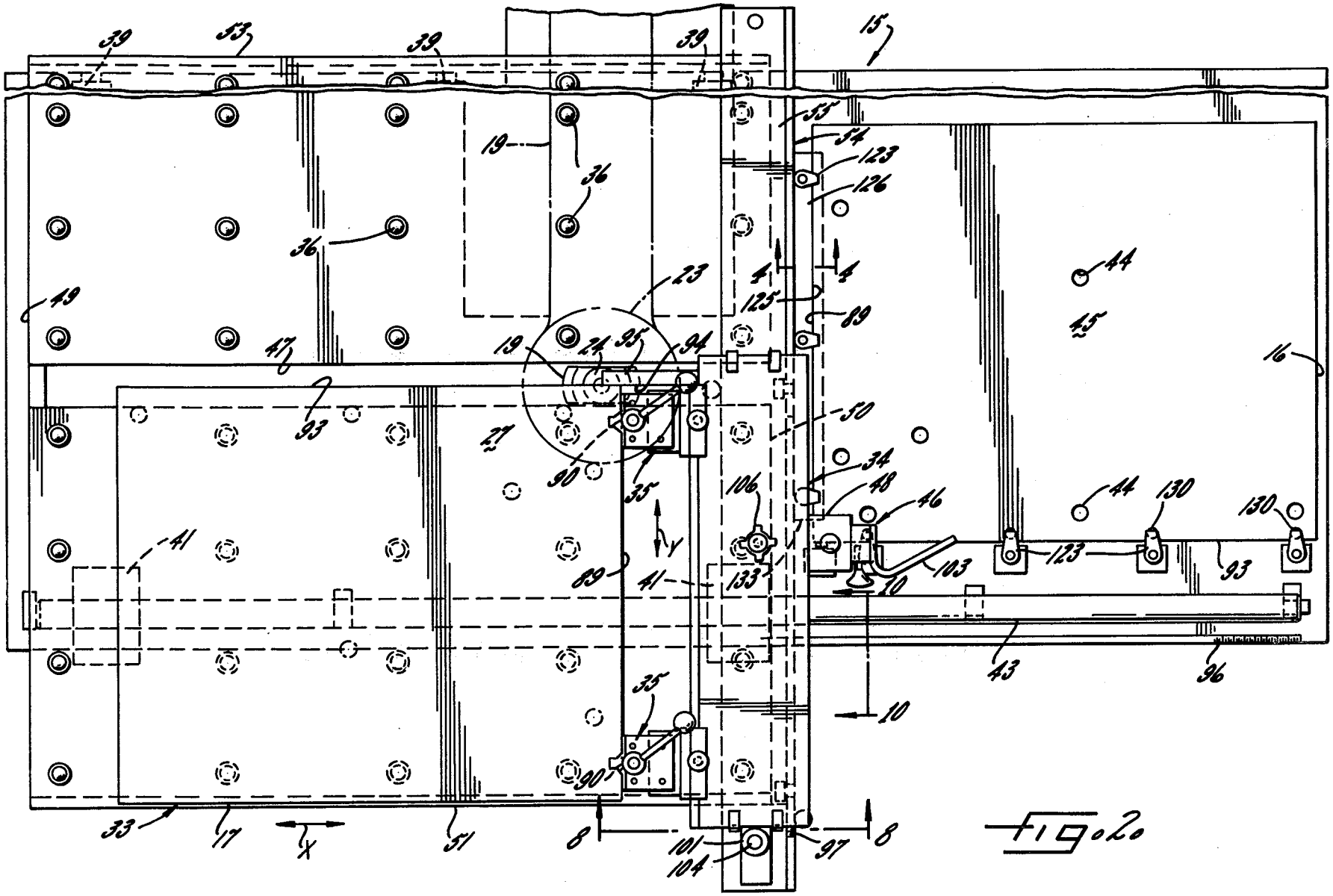
FIG. 2 is a fragmentary view taken substantially along line 2—2 of FIG. 1 with portions of the press shown in phantom lines for clarity of illustration.

As shown in the drawings for purposes of illustration, the present invention is embodied in a punch press 15 particularly adapted for use in producing duplicates of a piece part 16 such as a gusset plate, a splice plate, a base or cap plate or other similar structural plate which is formed of heavy thick metal from a workpiece blank 17. Herein, the press includes the usual C-shaped frame 19 secured to the floor and having a reciprocable ram 20 carrying a movable tool element or punch 21 on the lower end thereof. A fluid-operated actuator 23 supported on the upper portion of the frame connects with the ram to reciprocate the latter toward and away from a fixed tool element or die 24 located on the lower portion of the frame to punch holes in the blank when positioned between the punch and the die. Preferably, the blank is supported on a worktable 25 secured to the floor separately of the press so as to avoid movement of the table during punching. As shown in FIG. 2, the die extends upwardly through the worktable in a punching area 27 so that the die is supported above the top 29 of the table. When punching the blank, the slugs (not shown) fall through the die and into a slug bin 30 housed under the table.

Figure 3:
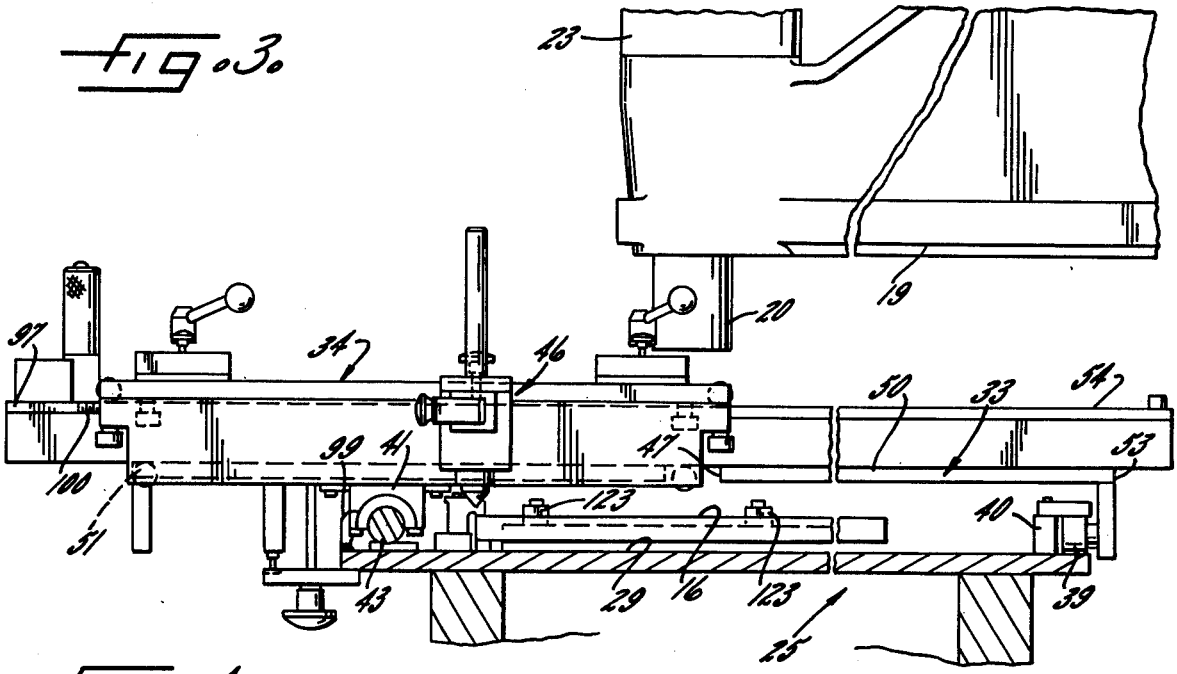
FIG. 3 is an enlarged cross-sectional view taken substantially along line 3—3 of FIG. 1.

Supporting the blank 17 on the worktable 27 is a bed 33 movable in an $x$ direction (see arrow in FIG. 2) on the table for positioning the blank between the punch 21 and the die 24. To keep the blank from lifting a substantial distance off the bed as the punch is withdrawn from the die, a stripper 31 adjustably fixed to the frame 19 and extending downwardly around the punch engages the upper surface of the blank, stripping the latter from the punch upon upward movement of the ram 20. Movement of the workpiece blank in the $y$ direction is accomplished by way of a carriage 34 secured to the bed and being movable therewith in the $x$ direction as well as being movable relative to the bed in the $y$ direction. To form the piece part 16 from the blank, the latter is secured to the carriage such as with one or more clamps 35 and, thus, may be moved in the *x* and *y* directions for positioning as desired between the punch and the die for the formation of a predetermined pattern of holes 44 in the blank. To make it easier to position the blank on the bed for punching, the bed includes a plurality of rollers 36 secured to the upper surface 37 thereof and supporting the workpiece blank in a relatively frictionless manner on the bed for movement in the *y* direction. In addition, the bed is supported in the table top by way of three spaced rollers 39 (see FIGS. 2 and 3) captivated within a channel 40 extending along the backside of the table. The front of the bed is supported on the table by two spaced roller bearing connections 41 engaging an elongated guide rod 43 which is fastened to the top 29 of the table along the front side thereof.

Figure 1:
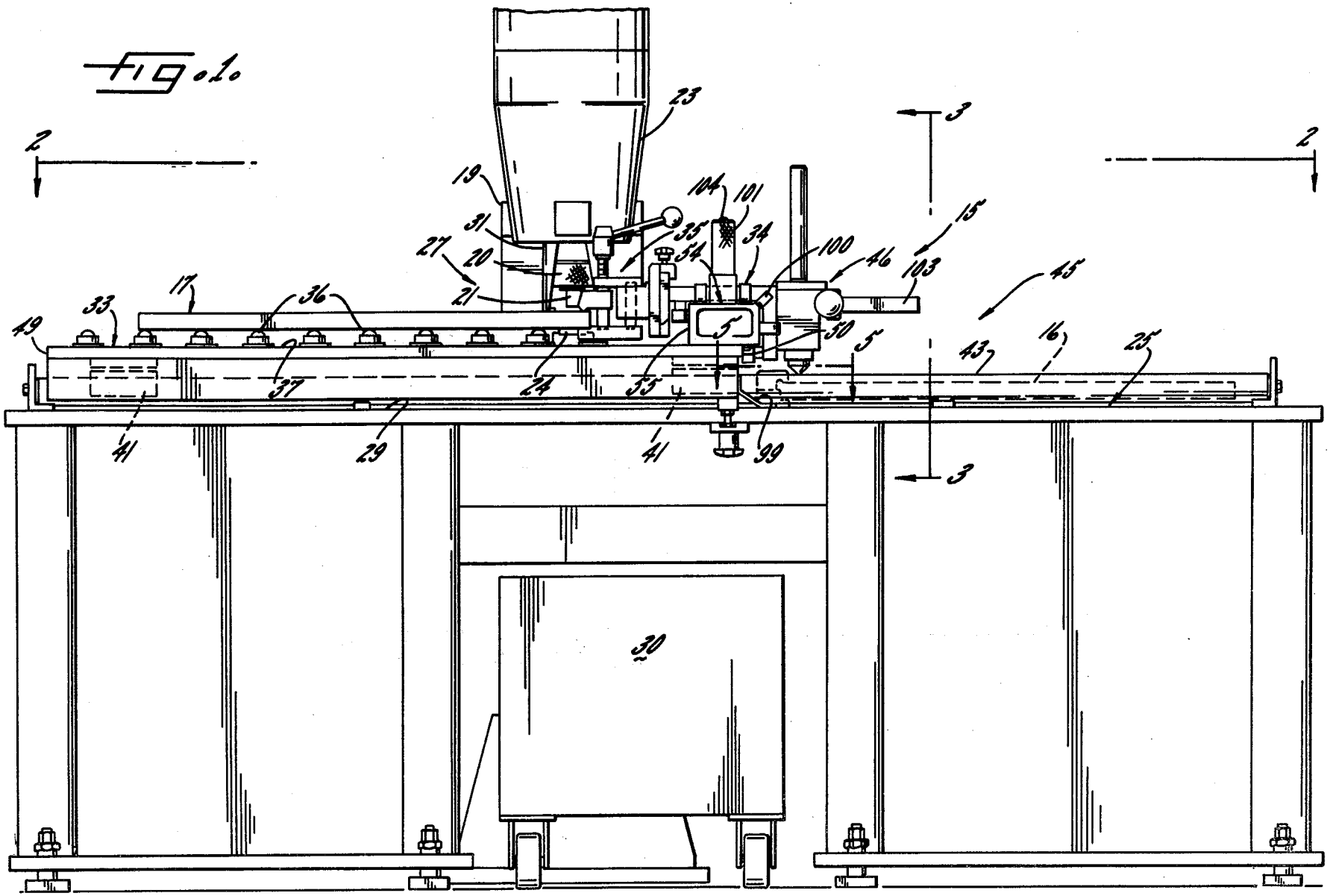
FIG. 1 is a fragmentary, front elevational view of a duplicating punch press embodying the novel features of the present invention.

As shown in FIG. 2, the bed 33 is a generally rectangular member having an elongated slot 47 extending from the left end 49 thereof to the right end 50 and generally parallel with the front and rear sides 51 and 53 of the bed. The die 24 protrudes upwardly through the slot to mate with the punch 21, the slot serving to permit the bed to be slid in the x direction relative to the die on the top of the table 25. Secured to the right end of the bed is a box beam 54 extending laterally across the bed with the underside 64 thereof protruding beyond the right end of the bed (see FIGS. 1 and 8). Herein, the carriage 34 comprises an elongated body 56 having a generally L-shaped cross section. Two vertically oriented rollers 57 are journaled within the horizontal leg 67 of the body at opposite ends thereof and engage the upper surface 59 of the beam. Also, at each end of the body two horizontal rollers 60 abut opposite sides of the beam. Journaled on the lower end of the vertical leg 61 of the body at each end thereof are vertical rollers 63 which, in this instance, ride against the projecting underside of the beam and serve to captivate the carriage on the beam for movement in the *y* direction on the bed.

Figure 8:
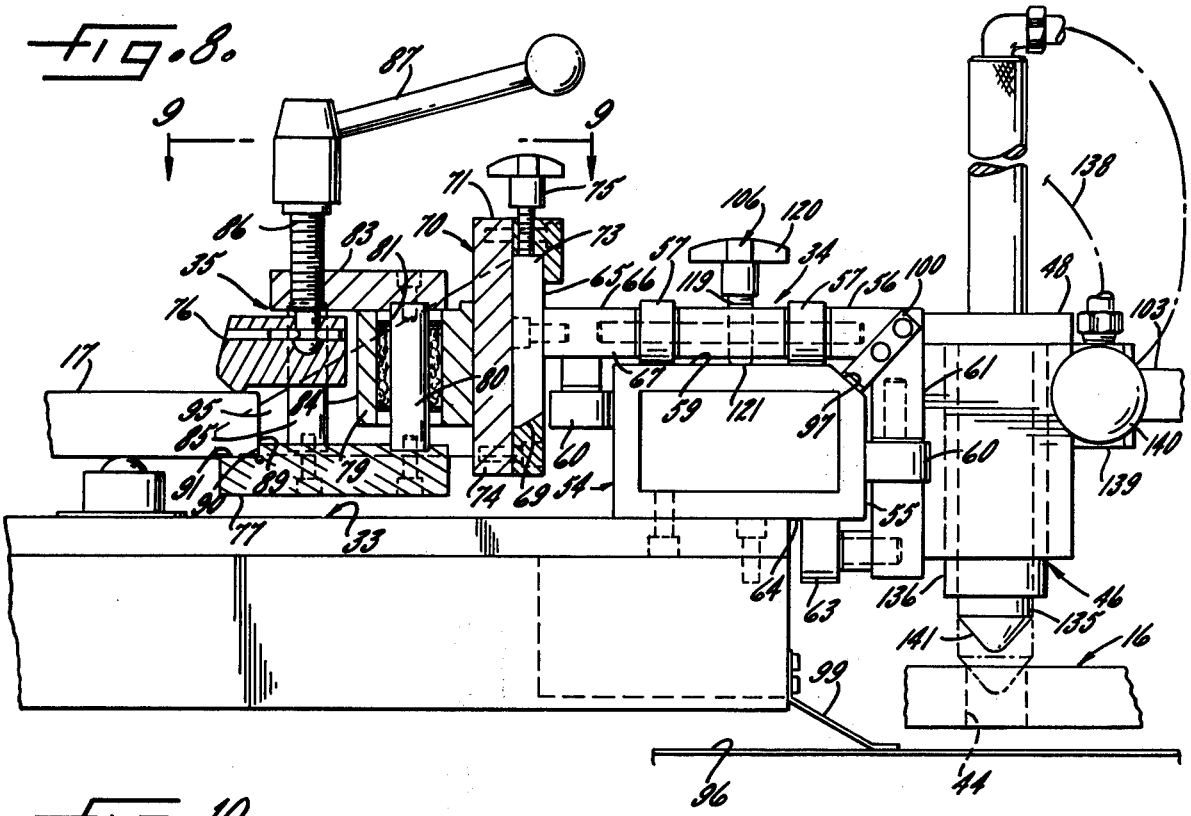
FIG. 8 is an enlarged, fragmentary view taken substantially along line 8—8 of FIG. 2 and showing parts of the press in cross section.

For different sizes of blanks, the clamps 35 are mounted adjustably on the carriage 34 to slide on an elongated bar 65 which is fixed to the opposite end 66 of the horizontal leg 67 of the body 56. Herein, the bar is spaced from the beam 54 toward the die 24 and extends edgewise in a generally vertical direction substantially along the full length of the body. Preferably, the lower edge 69 of the bar is slanted upwardly toward the body for connection with a generally C-shaped clamp support 70. As shown in FIG. 8, the upper end portion 71 of the clamp support hooks across the upper edge 73 of the bar and against the backside thereof while the lower portion 74 of the support engages the slanted lower edge of the bar. In this way, the support is prevented from sliding laterally off the carriage but is still free for sliding movement along the length of the bar. For fastening the clamp in a selected position along the length of the bar, a lock 75 is secured to the upper portion of the clamp and is engagable with the upper edge of the bar to draw the lower portion of the support tightly against the slanted edge thereby securing the clamp to the bar and carriage. Thus, the two clamps may be adjusted with respect to each other on the carriage for handling different sizes of workpiece blanks 17.

In accordance with one important aspect of the present invention, provision is made in the exemplary punch press 15 for clamping warped or bowed workpiece blanks 17 for movement with the carriage 34 and to eliminate introducing an undue strain or pressure on the clamps 35 as the punch 21 is withdrawn after punching one of the holes 44 in the blank. For these purposes, the clamps are formed with upper and lower jaws 76 and 77 slidably mounted on their supports 70 for movement in unison in a generally vertical direction during stripping while still being movable relative to each other to clamp and release the blank between such jaws. This construction enables the jaws to be moved vertically for gripping the margin of a blank, which by reason of a bow or warp may extend vertically out of the horizontal plane of the top of the bed 33, without placing an undue strain on the jaws during punching. Moreover, as the punch is stripped from the blank, the jaws ride upwardly with respect to their supports thereby keeping the blank from being cocked within and tending to bend the jaws.

Figure 9:
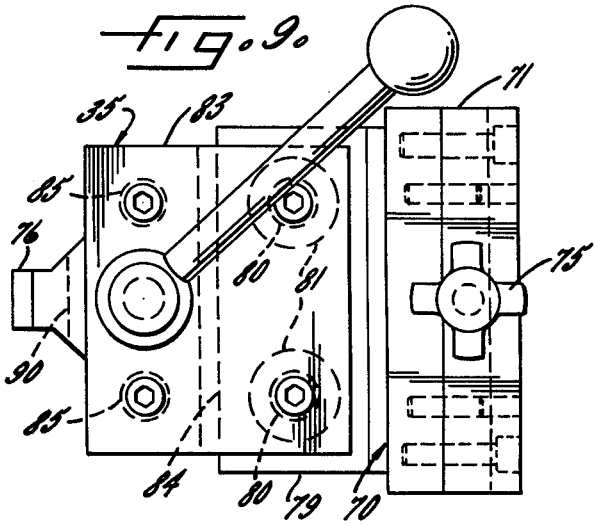
FIG. 9 is an enlarged, fragmentary view taken substantially along line 9—9 of FIG. 8.

In the present instance, the two clamps 35 are the same and, thus, the construction of only one of them will be described in detail, it being appreciated that such description applies equally well to the other. Accordingly, as shown in FIGS. 8 and 9, the clamp support 70 includes an outwardly projecting block 79 secured thereto between the upper and lower end portions 71 and 74 thereof. The lower jaw 77 of the clamp is connected to the block by way of two guide rods 80 telescoped through bushed openings 81 extending vertically through the block. The lower ends of the rods are connected to the lower jaw while the upper ends of the rods are fastened to a generally rectangular cap plate 83 which projects outwardly beyond the front face 84 of the block and over the lower jaw. Two more guide rods 85 spaced outwardly from the front face of the block again connect the cap plate to the lower jaw and the upper jaw 76 is slidably supported on these rods between the cap and lower jaw. To move the upper jaw 76 toward and away from the lower jaw 77, a shaft 86 is journaled to the upper jaw and extends upwardly therefrom to connect with a handle 87. The shaft is threaded through the cap plate 83 so that, as the handle is turned in one direction, the upper jaw is slid on the two front guide rods 85 toward the lower jaw and, when turned in the other direction, the upper jaw is slid away from the lower jaw. It will be appreciated that, with the upper and lower jaws mounted on the block in the foregoing fashion, the two jaws are free to slide vertically with respect to the support 70 to keep an undue strain from being placed on the jaws of the clamp as the punch 21 is stripped from the workpiece blank 17.

In accordance with another important aspect of the present invention, the exemplary press 15 is operated in a novel manner to produce a run of duplicates of the piece part 16 without the need of making a special hold pattern template for reproducing the desired pattern in the blanks being punched. Advantageously, this is achieved by first punching the desired pattern of holes 44 in the first blank of the run to form the first piece part 16. Then the completed first part is clamped in a fixed position with respect to the die 24 on the top 29 of the table 25 within a duplicating area 45 and a second blank 17 is clamped to the carriage 34. A reciprocable stylus 46 mounted on the carriage for movement therewith serves to locate and lock the latter on the table top in each of the proper positions for punching the desired pattern of holes in the second blank by telescoping into the holes previously formed in the first part. In this way, the second and successive blanks are located between the punch and die in their proper positions for punching holes in such blanks corresponding to the hole pattern in the first piece part. By virtue of clamping the first formed piece part within the duplicating area to provide the desired hole pattern, the need for a special template for the hole pattern is eliminated. This method of producing duplicate piece parts is particularly advantageous in the production of a short run of piece parts because the extra time otherwise required to produce a template for the hole pattern is eliminated. Moreover, inasmuch as the model for producing the duplicate piece parts is itself a usable piece part, the need for template storage is eliminated. A still further advantage is that use of the first piece part as a model for punching the hole pattern eliminates potential punching errors that otherwise may result from enlarged pattern holes caused by wear in less sturdy templates.

In forming the first piece part 16 from a workpiece blank, the latter is placed between the jaws 76 and 77 of the clamp 35 in a located position with the leading side edge 89 of the blank abutting an *x* directional located edge 90 formed in the lower jaw 77 by a notch 91 (see FIG. 8). The rearward edge 93 of the blank abuts a *y* directional locating surface 94 (see FIG. 2) adjacent the rearward end of the carriage 34. Herein, the *y* locating surface is defined by the front face of a wing-shaped plate 95 secured to the carriage and extending therefrom in the *x* direction generally toward the frame 19 of the press 15. Accordingly, when the blank is placed between the jaws of the clamp and into abutting engagement with the locating edge 90 and the locating surface 94, the blank is set for movement referenced to the die 24.

For ease in moving the bed 33 and carriage 34 when locating the blank 17 between the punch 21 and die 24 for punching, and for purposes of safety in the operation of the punch press 15, a handle 101 is connected to the bed for moving the latter in the *x* direction. In particular, the handle is mounted on the front end portion of the box beam 54 being positioned upright from the upper surface 59 thereof. For movement in the *y* direction, a horizontal handle 103 is connected to the carriage body 56 intermediate the ends thereof and extends outwardly from the carriage generally over the duplicating area 45. With this arrangement of the handles 101 and 103, the operator of the press is able to stand along the front of the table 25 with one hand on the upright handle and the other hand on the horizontal handle for easy maneuvering of the workpiece blank 17 when operating the press. For punching holes in the blank, preferably a control button 104 for operating the punch press actuator 23 to perform a punching operation is located on the upright handle so that the punch may be advanced without removing either hand from the two handles. Thus, it is seen that by virtue of the foregoing described arrangement, not only are the operator's hands kept well out of the punching area, but the arrangement lends itself to easy and quick *x*, *y*, movement of the blank 17 for punching.

Advantageously, the press 15 is provided with *x* and *y* directional scales 96 and 97 referenced to the die 24 with the *x* directional scale located on the tip 29 of the table 25 along the bed supporting rod 43. An indicator arm 99 secured to the right end 50 of the bed is carried by the latter to indicate measured distances of movement of the blank 17 in the *x* direction from the leading side edge 89 of the blank when positioning the blank over the die 24. In a similar manner, the *y* directional scale 97 is located on the box beam 54 along the leading upper edge thereof and an indicator arm 100 secured to the carriage 34 provides the means for reading measured *y* distances of movement of the blank with respect to the die. In forming the first piece part 16, the *x* and *y* directional scales 96 and 97 may be used to locate the positions for punching the holes in the blank without the need of a special template for this purpose. If desired, however, the hole positions may be marked initially on the blank in some other manner for punching.

Figure 10:
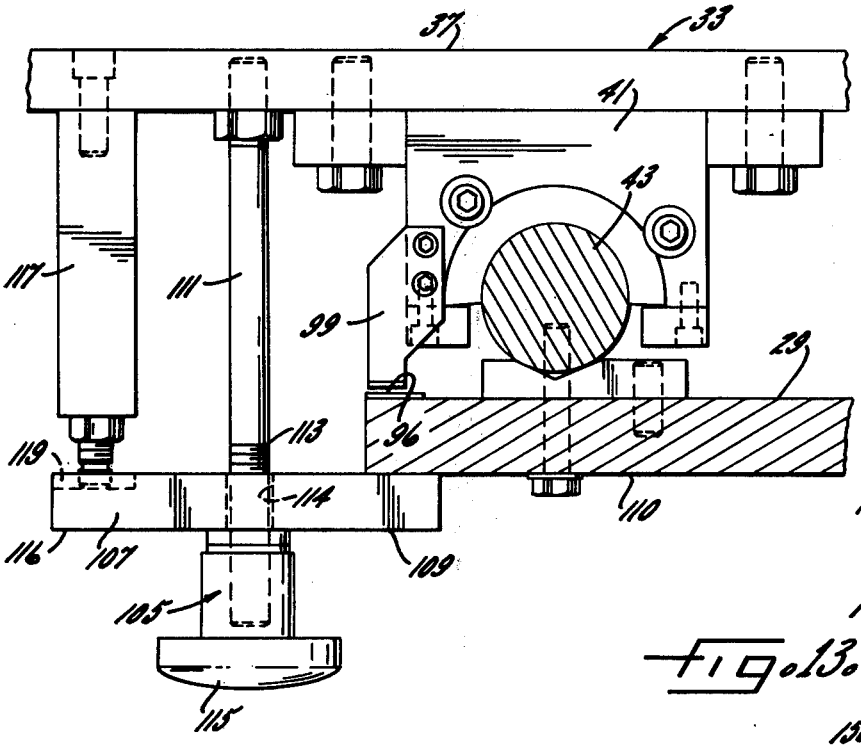
FIG. 10 is an enlarged, fragmentary, cross-sectional view taken substantially along line 10—10 of FIG. 2.

When using the exemplary press 15 to punch holes 44 in the blank 17 along lines extending in either the x or y directions, locking mechanisms 105 and 106 for the bed 33 and the carriage 34, respectively, provide the means whereby either the bed or the carriage may be locked in place while still allowing the other to be moved. The locking mechanism 105 for the bed is shown best in FIG. 10 and includes a friction block 107 carried below the front side 51 of the bed. An inner end margin 109 of the block extends beneath the top 29 of the worktable 25 for frictional engagement with the underside 110 of the table to keep the bed from being moved in the *x* direction. Preferably, the block is supported on the bed by a rod 111 secured to the underside of the bed and depending therefrom adjacent the front edge of the table top. Herein, a threaded lower end portion 113 of the rod is telescoped through a somewhat larger aperture 114 in the block and a knob 115 is threaded on such portion for turning to move the block upwardly or downwardly on the rod. To provide for leverage against the table top when turning the knob upwardly on the rod, the outer end portion 116 of the block is held against upward movement by an adjustable stop 117. The latter extends downwardly from a connection with the underside of the bed to engage the block within a recess 119 and thereby provide a fulcrum for applying a locking force to the table top to keep the bed from being slid in the *x* direction. Thus, if it is desired to punch a series of holes 44 in the y direction along a line located at a certain *x* distance from the leading edge 89 of the blank 17, such may be accomplished easily by moving only the carriage once the bed is locked in the desired *x* position.

The locking mechanism 106 for the carriage 34 is shown in FIG. 8 to include a shaft 119 threaded through the horizontal leg 67 of the carriage body 56 for engagement with the upper side 59 of the box beam 54. A knob 120 fixed on the upper end of the shaft aids in turning the shaft to draw the body upwardly of the beam so that the lower end 121 of the shaft locks frictionally against the beam to keep the carriage from being moved in the y direction relative to the bed 33. Accordingly, when punching a series of holes 44 in the blank 17 along a line extending in the *x* direction, the carriage may be locked easily to locate such line at a selected *y* distance from the rearward edge 93 of the blank. Thus, only the bed need be moved when punching the holes in the *x* direction without worry of the carriage moving off line when moving from spot to spot for punching.

Figure 4:
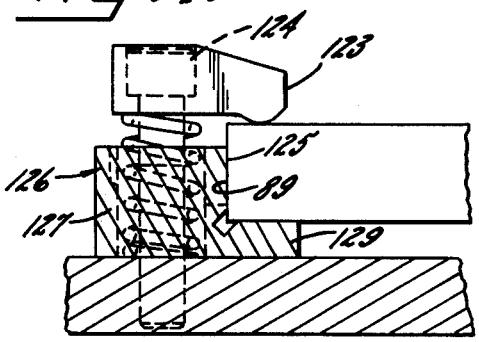
FIG. 4 is an enlarged, cross-sectional view taken substantially along line 4—4 of FIG. 2.
Figure 5:
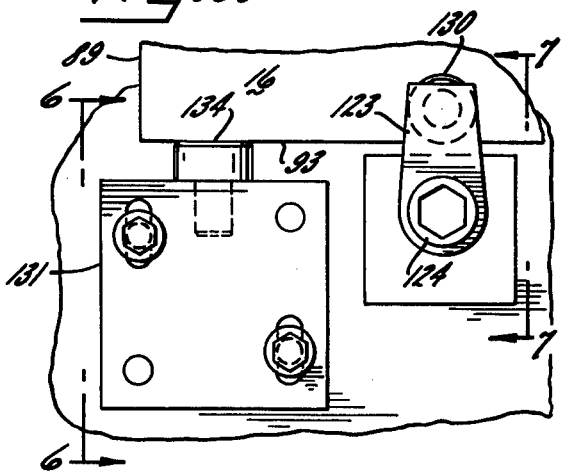
FIG. 5 is an enlarged, fragmentary view taken substantially along line 5—5 of FIG. 1.
Figure 6:
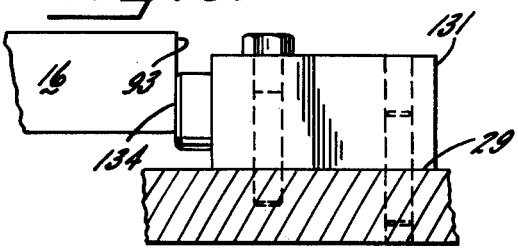
FIG. 6 is a fragmentary cross-sectional view taken substantially along line 6—6 of FIG. 5.
Figure 7:
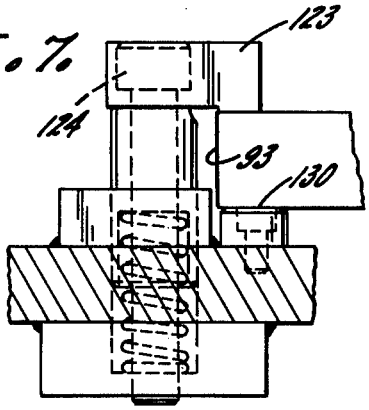
FIG. 7 is a fragmentary cross-sectional view taken substantially along line 7—7 of FIG. 5.

After the desired hole pattern is punched in the first workpiece blank 17 to produce the first piece part 16, the latter is placed in the duplicating area 45 in a predetermined location with respect to the die 24. As shown in FIG. 2, the first part is clamped to the top 29 of the table 25 within the duplicating area by a series of edge clamps 123. Herein, four such edge clamps are secured to the table top at spaced positions located rearwardly of and along the support rod 43 in the $x$ direction and three of the edge clamps are secured to the top of the table at spaced positions along the left side boundary of the duplicating area in the y direction. Each of the clamps is tightened toward the duplicating area by way of a screw 124 threaded into the table (see FIGS. 4, 5 and 7).

To locate the first piece part 16 accurately within the duplicating area 45, the leading edge 89 of the part is placed in abutting engagement with an $x$ locating edge 125 of a bar 126 which extends laterally across the top of the table between the front and rear sides thereof. As shown in FIG. 2, the bar is secured to the table top 29 with the locating edge extending in the y direction along a line projected from the origin of the $x$ directional scale 96. More particularly, the bar is of a generally L-shaped cross-section (see FIG. 4) with the face of the vertical leg 127 thereof serving as the locating edge. The horizontal leg 129 of the bar provides a shoulder upon which the leading marginal edge 89 of the piece part rests in a position spaced slightly above the surface of the table 25. Spacing the piece upwardly from the table surface along the side edge margin 93 of the part are four spacer buttons 130 associated, respectively, with the four clamps 123 which are positioned along the support rod 43. For location of the side edge of the piece part in the duplicating area, a locating block 131 adjacent the forward end 133 of the bar includes a rearwardly extending projection 134. The latter serves as a $y$ directional locating shoulder for abutment with the edge 93 of the piece part so that between the bar 126 and the projection 134 the part is located accurately within the duplicating area 45 relative to the die 24, the two edges 89 and 93 of the part being positioned on the zero lines of the $x$ and $y$ directional scales, respectively.

Once the first piece part 16 is located and clamped within the duplicating area 45, each subsequent duplicate of the part is formed one at a time by first locating one workpiece blank 17 of the run between the jaws 76 and 77 of the carriage clamps 35 and then moving the carriage 34 to position the blank between the punch 21 and the die 24, utilizing the stylus 46 in conjunction with the hole pattern provided by the first part to locate the blank in the positions required for punching holes according to the desired pattern. When locating the blank between the clamp jaws, the blank is placed in abutment with the locating edges 90 on the lower jaws and the locating surface 94 at the rearward end of the carriage. In this way, the edges 89 and 93 of the blank are located with respect to the position of the stylus in the same relationship that the edges 89 and 93 of the first piece part 16 are located with respect to the die 24 (see FIG. 2). Accordingly, when the stylus is directly over one of the holes 44 in the first piece part, the blank secured to the carriage is positioned between the punch and die for a corresponding hole to be punched in such blank.

As shown in FIG. 8, the stylus 46 is mounted within a housing 48 attached to the vertical leg 61 of the carriage body 56 and comprises a reciprocable, fluid actuated plunger 135 captivated within a suitable cylinder 136. The latter is connected to a line 138 communicating with a suitable pressure source (not shown) for actuation of the cylinder to reciprocate the plunger. Advantageously, a valve 139 controlling the flow of fluid into and out of the cylinder is operated by way of an actuator knob 140 located closely adjacent the carriage handle 103. As a result, the stylus may be actuated by the press operator's thumb without having to release the handle as the blank is moved with the carriage 34 from place to place on the table 25 for punching. Preferably, the lower end of the plunger is provided with a removable tip 141 particularly adapted to fit within different sizes of holes 44 that may be punched in the first piece part. Herein, the tip is of an inverted generally conical shape so as to fit within holes of different diameters within a range generally limited by the maximum and minimum diameters of the conically shaped tip. By virtue of this construction, the tip of the stylus need not be changed for different sizes of holes in any one pattern or between different patterns. Moreover, the shape of the tip provides for much quicker, easier and accurate positioning of the blank between the punch 21 and the die 24. This is because the press operator may quickly locate the stylus over a hole roughly by eye and utilize the tip to cam the carriage and blank accurately into a punching position corresponding to the position of the hole as the tip centers within the hole. In addition, by using the stylus with the first formed piece part 16, the stylus not only serves to locate the blank 17 for punching, but also serves to temporarily lock the carriage against movement during punching so as to assure that the hole being punched will be placed accurately in the blank.

Thus, it is seen from the foregoing that the exemplary punch press 15 is adapted particularly for use in quickly and easily punching a plurality of the workpiece blanks 17 to produce duplicates of the piece part 16. Advantageously, this is accomplished by utilizing the first formed piece part as a pattern from which the subsequent piece parts are formed. In forming the piece parts, the first part is clamped within the duplicating area 45 on the table 25 so the stylus 46 may be used to accurately locate and lock each subsequent workpiece blank between the punch 21 and die 24 for the blanks to be punched one at a time with holes arranged in a pattern corresponding to the hole pattern in the first part. Advantageously, he clamps 35 securing the blanks to the carriage 34 are constructed so the jaws 76 and 77 thereof may float vertically during stripping to avoid placing an undue strain against such jaws as the punch is withdrawn from the die. In addition, the press is constructed in such fashion so as to encourage the punch press operator to use both hands to move the bed 33 and the carriage for efficient operation of the press. Accordingly, the operator's hands are kept safely out of the way to reduce substantially the risk of injury when operating the press.

In accordance with still another aspect of the present invention, provision is made of a unique adapted 143 and a locator mechanism 144 enabling the press 15 to be utilized to punch holes in an angle iron workpiece 145 to form a clip angle such as is used in jointing together abutting structural members (not shown) at right angles to each other. For this purpose, the adapter is constructed so as to be fastened removably to the carriage 34 by the two clamps 35 to carry the workpiece with the carriage as the latter is moved on the bed 33. The locator mechanism includes an elongated member 150 which is secured to the table bed 33 below the carriage and which cooperates with a plunger 151 attached to the carriage to position the workpiece selectively between the punch 21 and the die 24 in the punching area 27 to assure proper spacing of the holes as the carriage is moved from spot to spot across the bed. Advantageously, with the clip angle adapter and the locator mechanism, the exemplary press may be used for producing clip angles in addition to the flat piece parts 16 such as the base plates, gusset plates and other types of structural plates previously mentioned.

In the exemplary form of the present invention, the adapter 143 includes an elongated, generally rectangular body member 153 having opposite ends 147 and 149 attached thereto. In use, the body is secured to the carriage 34 between the jaws 76 and 77 of the clamps 35 with the jaws clamped to the body adjacent the opposite ends thereof (see FIG. 12). To retain the angle iron workpiece 145 within the locator, the latter includes a traveler 154 mounted on a threaded rod 155 which extends between the opposite ends of the body. Herein, the rod extends through an internally threaded hole 156 in the traveler and is rotatable within the ends of the body member. Attached to one end 157 of the rod outside of the body is a handle 159 for turning the rod. The lower side of the traveler is provided with a suitable notch 160 (see FIG. 11) receiving an elongated bar 161 to prevent the traveler from turning with the rod. Accordingly, as the rod is rotated, the traveler is slid along the bar either toward or away from the end 149 of the body to either grip or release the angle iron workpiece. As an aid in holding the workpiece against movement within the adapter, the interior surfaces 163 and 164 of the end 149 and the traveler are provided with suitably shaped recesses 165 and 166, respectively (see FIG. 12).

To punch holes in the angle iron workpiece 145 once the latter is captivated within the adapter 143 for movement with the carriage 34, the bed 33 is set at a desired $x$ distance from the die 24 and the locking mechanism 105 is tightened to prevent the bed from moving out of such position. The locking mechanism 106 is left loose so that the carriage is free to be moved in the $y$ direction to slide the workpiece lengthwise between the punch 21 and the die for punching a series of spaced holes longitudinally along the horizontal leg of the workpiece. In order to obtain the proper spacing between holes, the locator member 150 includes a series of evenly spaced, U-shaped notches 167 (see FIG. 13) formed in the upper margin 169 thereof and the plunger 151 is located on the carriage to telescope into the notches so as to locate the selected positions for punching holes in the workpiece. Herein, the plunger is mounted through the horizontal leg 67 of the carriage body 56 and adjacent the clamp support 70 (see FIG. 11). A spring 170 telescoped over the lower end portion 171 of the plunger acts between the underside of the horizontal leg and an enlarged lower tip 173 on the plunger to urge the latter downwardly to seat within the notches.

For quickly positioning the carriage 34 and angle iron workpiece 145 within the punching area 27 the tip 173 of the plunger 151 is provided with a lower surface 180 which slants upwardly upon progressing from the backside 181 of the tip toward the front side thereof. Accordingly, when the press operator pulls the carriage from its rearmost position on the box beam 54, the plunger sides easily from notch 167 to notch in the locator with the surface 180 camming the plunger upwardly upon leaving each notch. Advantageously, the backside of the tip is provided with a generally vertical flat 183 adapted to abut with the rearward sides 184 of the notches. Thus, as the plunger is felt to drop into each of the notches, the carriage may be pushed slightly rearward so the flat serves to locate the carriage accurately with respect to the notches and thus, in turn, accurately locates the angle iron workpiece between the punch 21 and the die 24 for punching evenly spaced holes in the workpiece.

Figure 13:
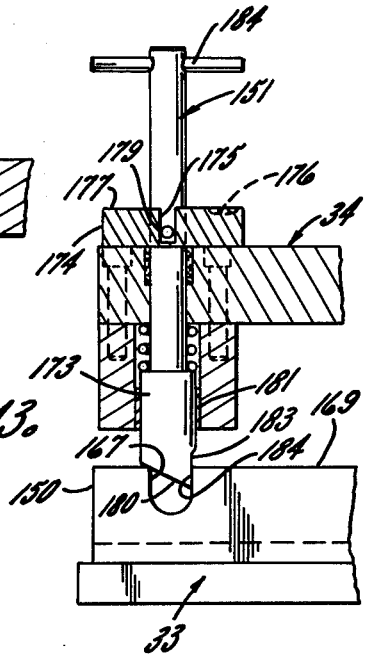
FIG. 13 is a fragmentary, cross-sectional view taken substantially along line 13—13 of FIG. 11.
Figures 11, 12:
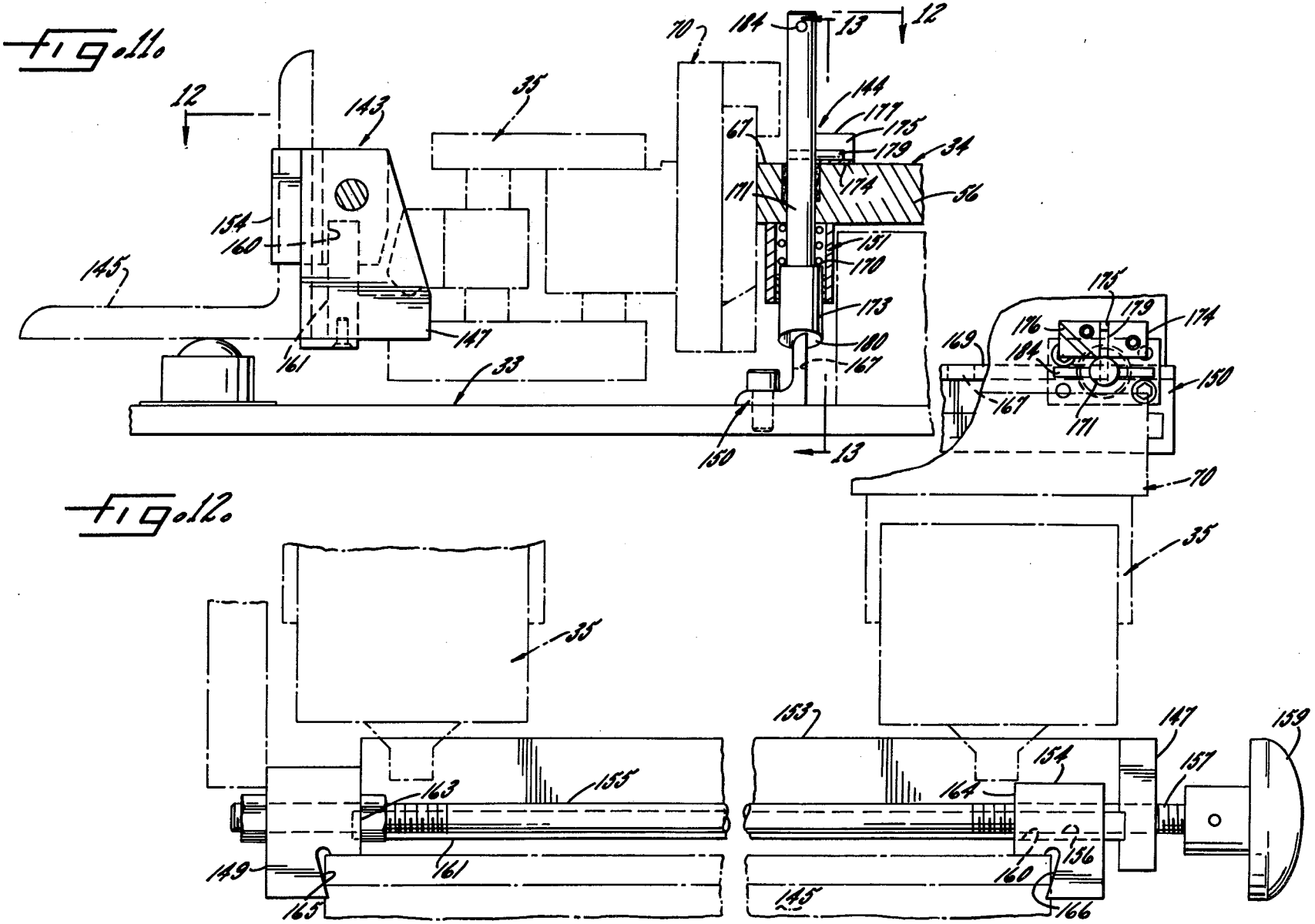
FIG. 11 is a fragmentary, enlarged, cross-sectional view generally similar to FIG. 8 and showing certain additional parts of the press with other parts of the press being shown in phantom.
FIG. 12 is a fragmentary view taken substantially along line 12—12 of FIG. 11.

As shown in FIGS. 11, 12 and 13, a block 174 is mounted on the carriage body 56 adjacent the plunger 151 and includes two angularly spaced grooves 175 and 176 formed in the upper surface 177 thereof. Advantageously, the two grooves are of different depths, the groove 175 being formed virtually through the block while the other groove 176 is substantially shallower. A generally radial arm 179 attached to the upper end portion of the plunger is sized to fit within the grooves so that, when in the shallower groove, the tip of the plunger is held upwardly of the locator but, when in the deeper groove, the plunger is free to slide downwardly to telescope into the U-shaped notches 167. As the plunger moves up and down when riding across the locator, the arm remains in the deeper groove 175 to keep the lower surface 180 and the flat 183 properly oriented with respect to the notches. But, when returning the carriage to its rearmost position for punching holes in the other leg of the workpiece, the plunger is lifted into a raised position such as by means of a handle 184 attached to the upper end portion thereof and is twisted to move the arm into the shallower groove 176 so the tip is free to pass over the notches. This arrangement also permits the plunger to be carried in its retracted position when the press is being used to punch a pattern of holes in workpiece blanks 17 such as those previously mentioned.

Thus, it is seen from the foregoing that the unique adapter 143 and the locator mechanism 144 enable the exemplary press 15 to be used in forming an angle iron workpiece 145 into a clip angle as well as to be used in forming duplicates of the piece part 16 from flat metal workpiece blanks. In use, the adapter is clamped to the carriage, gripping against the opposite ends of the angle iron workpiece to hold it for movement with the carriage. To assure proper spacing of the holes to be punched in the workpiece, the notched member 150 of the locator mechanism coacts with the plunger 151 to aid in locating the various spots across the bed 33 at which the carriage need be stopped for punching of the workpiece.

I claim:

1. A punch press for producing duplicate piece parts one at a time from a plurality of workpiece blanks, said press including an upright frame, an acutator mounted on said frame, a fixed tool element mounted on said frame and spaced from said actuator, a movable tool element connected to said actuator and movable thereby toward and away from said fixed tool element, a stripper connected to said frame adjacent said movable tool element, a worktable with a top having a punching area located around said fixed tool element and a duplicating area disposed to one side of said punching area, a movable bed slidably mounted on said table above said top for movement across said tip in only an $x$ direction within said punching area and over said duplicating area, a carriage slidably mounted on said bed for bodily movement therewith in said $x$ direction and for movement relative to said bed only in a $y$ direction thereby to produce $x$, $y$ movement relative to said table top, a first formed piece part having a pattern of holes formed therethrough and being clamped removably to the top of said table within said duplicating area in a predetermined position from said fixed tool element, a reciprocable stylus connected to said carriage for movement toward and away from engagement with said piece part and for *x* and *y* movement with said carriage and bed across said duplicating area, a workpiece blank, a clamp secured to said carriage and including upper and lower jaws movable relative to each other to fasten said blank to said carriage, said blank extending from said carriage, into said punching area and being positioned with respect to said stylus so that, as said carriage is moved to position said stylus over the different holes in said piece part, said blank is located in corresponding positions relative to said fixed and movable tool elements, a lower tip mounted on said stylus and shaped to center within each of the holes in said piece part for a predetermined range of hole sized so as to locate and lock said carriage, bed and blank accurately in said corresponding positions for punching a hole pattern in said blank substantially identical to the hole pattern in said piece part, and means mounting said jaws on said carriage for vertical movement with said blank as the latter is stripped from said movable tool element by said stripper, said means comprising a support mountable on said carriage, a cap connected to said support and extending outwardly therefrom in a generaly horizontal direction above said jaws, a first pair of spaced guide rods connected between said cap and said lower jaw with said guide rods extending vertically and slidably through said support so said cap and said lower jaw are mounted for vertical movement together with respect to said support, a second and similar pair of spaced guide rods connected vertically between said cap and said lower jaw and spaced from said support, said upper jaw being slidably mounted on said second pair of guide rods between said cap and said lower jaw, and means for moving said upper jaw on second pair of guide rods toward and away from said lower jaw to clamp and release said workpiece blank.

2. A punch press as defined by claim 1 including an elongated bar secured to said table top and having an outer edge extending in the *y* direction, said edge being spaced from said fixed tool element a selected distance in the *x* direction and positioned in abutment with one edge of said first formed piece part to locate the latter said selected distance from said fixed tool element, a locating shoulder positioned on said table to within said duplicating area and adjacent one end of said bar, said shoulder being spaced from said fixed tool element a predetermined distance in the *y* direction and abutting one other edge of said first formed piece part to locate the latter said predetermined distance from said fixed tool element, a locating edge and a locating surface connected to said carriage at said preselected and predetermined distances from said stylus, respectively, said workpiece blank having one and other edges corresponding to said one and other edges of said piece part abutting said locating edge and said locating surface, respectively, to position said blank said preselected and said predetermined distances from said stylus.

3. A punch press as defined by claim 2 wherein said stylus tip is of an inverted generally conical shape.

4. A punch press as defined by claim 2 including a first handle fixed to said carriage for moving the latter in said *y* direction, a second handle fixed to said bed for moving said bed in an *x* direction, an actuator knob on said carriage adjacent said first handle for actuation of said stylus while gripping said first handle, and a control button on said bed adjacent said second handle for actuating said punch press actuator while gripping said second handle.

5. A punch press as defined by claim 4 wherein said fixed tool element projects upwardly through said table top in said punching area and into said bed, said bed having an elongated slot formed therethrough, extending in said *x* direction and receiving the upper end portion of said fixed tool element.

6. A punch press for producing duplicate piece parts one at a time from a plurality of workpiece blanks, said press including an upright frame, an actuator mounted on said frame, a fixed tool element mounted on said frame and spaced from said actuator, a movable tool element connected to said actuator and movable thereby toward and away from said fixed tool element, a worktable with a top having a punching area located around said fixed tool element, a movable bed slidably mounted on said table above said top for movement across said top in only an *x* direction within said punching area, a carriage slidably mounted on said bed for bodily movement therewith in said *x* direction and for movement relative to said bed only in a *y* direction thereby to produce *x*, *y* movement of said carriage relative to said table top, means for locking said bed against movement in said *x* direction from a selected position with respect to said fixed tool element, mechanism mounted on said carriage and including parts movable toward and away from said table top for locating said bed and said carriage selectively with respect to said fixed tool element and and a clamp mounted on said carriage, extending outwardly therefrom toward said fixed tool element for securing a workpiece blank to said carriage for movement therewith, said clamp including a support attached to said carriage, a lower jaw connected to and being movable on said support in a generally vertical direction toward and away from said bed, an upper jaw connected to said lower jaw and being movable toward and away from said lower jaw to clamp said workpiece between said jaws, said upper jaw also being movable bodily with said lower jaw in said vertical direction with respect to said bed and said support.

7. A punch press as defined by claim 6 wherein said workpiece blank is an angle iron having a generally vertical leg and a generally horizontal leg disposed between said fixed and movable tool elements in said selected position, said carriage having two of said clamp spaced from each other along said carriage, an elongated adapter extending between and said clamps clamped to said carriage by the jaws of said clamps, said adapter comprising a body with means supported thereon for releasably securing said blank to said carriage for movement therewith in said y direction, said bed being held against movement in said *x* direction by said means for locking said bed against movement from said selected position for punching holes in said leg in said *y* direction along said leg, said mechanism including an elongated member secured to said table adjacent said carriage and extending in said *y* direction, a plunger connected to said carriage and coacting with said member to position said blank selectively between said tool elements in spaced *y* positions for punching a predetermined pattern of holes in said horizontal leg of said blank.

8. A punch press as defined by claim 2 wherein said member includes a series of spaced, upwardly-opening, generally U-shaped notches formed therein, said plunger having a lower end adapted to telescope into said notches to locate said carriage in said spaced *y* positions, said plunger including means urging said lower end downwardly, and a generally horizontal arm extending outwardly from the upper end of said plunger to support said plunger in a raised position.

9. A punch press as defined by claim 7 wherein said means for releasably securing said blank to said carriage includes an externally threaded rod journaled between the opposite ends of said body, an internally threaded traveler mounted on said rod and held against rotation with respect to said body whereby as said rod is turned said traveler moves along said rod to clamp or release said blank to said body.

* * * * *